US008264317B2

(12) United States Patent
Higashikata

(10) Patent No.: US 8,264,317 B2
(45) Date of Patent: Sep. 11, 2012

(54) PROTECTIVE DEVICE OF THREE-PHASE MOTOR

(75) Inventor: Isao Higashikata, Nagoya (JP)

(73) Assignee: Ubukata Industries Co., Ltd., Nagoya-Shi, Aichi (JP)

( * ) Notice: Subject to any disclaimer, the term of this patent is extended or adjusted under 35 U.S.C. 154(b) by 0 days.

(21) Appl. No.: 13/127,600

(22) PCT Filed: Nov. 5, 2008

(86) PCT No.: PCT/JP2008/003177
§ 371 (c)(1),
(2), (4) Date: May 4, 2011

(87) PCT Pub. No.: WO2010/052750
PCT Pub. Date: May 14, 2010

(65) Prior Publication Data

US 2011/0210813 A1 Sep. 1, 2011

(51) Int. Cl.
*H01H 37/74* (2006.01)
*H01H 37/54* (2006.01)
*H01H 71/00* (2006.01)
*H01H 61/00* (2006.01)

(52) U.S. Cl. ..... 337/343; 337/362; 337/380; 337/365; 337/107; 337/112

(58) Field of Classification Search ..... 337/142, 337/107, 112, 365, 380, 362, 343
See application file for complete search history.

(56) References Cited

U.S. PATENT DOCUMENTS 3,452,313 A 6/1969 Perry
3,753,195 A * 8/1973 Woods ..... 337/347
(Continued)

FOREIGN PATENT DOCUMENTS

JP S46-34532 8/1971
(Continued)

OTHER PUBLICATIONS

Office Action dated Mar. 1, 2012, in Mexican Patent Application No. MX/a/2011/004399.

*Primary Examiner* — Bradley Thomas
(74) *Attorney, Agent, or Firm* — Thomas & Karceski, PC

(57) ABSTRACT

A protector for a three-phase electric motor has a container with a housing and a metal plate secured thereto. A protrusion is provided in the housing. Three conductive terminal pins, each with a fixed contact, protrude into the housing through the metal plate. A thermally responsive plate is connected to the three moveable contacts. The thermally responsive plate is dish shaped and reverses its direction of curvature at a predetermined temperature. Three moveable contacts are secured to the thermally responsive plate. An elastic member extends between the protrusion and the thermally responsive plate. A rotation member prevents the thermally responsive plate from rotating, thereby maintaining the moveable contacts in opposition to the fixed contacts. The conductive terminal pins are located at a neutral point side of phase windings of a three-phase motor so that AC current flowing into the three-phase motor is interrupted.

6 Claims, 12 Drawing Sheets

U.S. PATENT DOCUMENTS

| | | | | | |
|---|---|---|---|---|---|
| 3,871,939 | A * | 3/1975 | Woods | 156/293 |
| 4,231,010 | A * | 10/1980 | Cardin | 337/94 |
| 4,555,686 | A * | 11/1985 | Pejouhy et al. | 337/102 |
| 4,843,363 | A * | 6/1989 | Ubukata et al. | 337/94 |
| 4,866,408 | A * | 9/1989 | Petraitis et al. | 337/104 |
| 5,212,465 | A * | 5/1993 | Mizutani et al. | 337/368 |
| 7,109,840 | B2 * | 9/2006 | Turner et al. | 337/377 |
| 7,298,239 | B2 * | 11/2007 | Yamada | 337/107 |
| 2003/0102954 | A1 * | 6/2003 | Herrick | 337/102 |

FOREIGN PATENT DOCUMENTS

| | | |
|---|---|---|
| JP | S51-91774 | 7/1976 |
| JP | S53-42145 | 4/1978 |
| JP | S55-165534 | 12/1980 |
| JP | S56-99938 | 8/1981 |
| JP | H01-279532 | 11/1989 |

* cited by examiner

PROTECTIVE DEVICE OF THREE-PHASE MOTOR

CROSS-REFERENCE TO RELATED APPLICATION(S)

This is a National Stage Entry into the United States Patent and Trademark Office from International PCT Patent Application No. PCT/JP2008/003177, having an international filing date of 5 Nov. 2008, the contents of which are incorporated herein by reference.

TECHNICAL FIELD

The present invention relates to a protector for a three-phase electric motor, having a contact switching mechanism using a thermally responsive plate such as a bimetal in a hermetic container and used to interrupt an AC current flowing into a three-phase motor.

BACKGROUND ART

U.S. Pat. No. 3,452,313 (prior art document 1) discloses a protector for a three-phase motor, of the above-described type, for example. The protector described in prior art document 1 comprises a thermally responsive plate including a bimetal provided in a hermetic container comprising a metal housing and a metal plate. Three conductive terminal pins are hermetically fixed to the metal plate. The terminal pins have respective one ends which protrude in the hermetic container and to which fixed contacts are secured respectively. On the other hand, movable contacts are secured to portions of the thermally responsive plate opposed to the fixed contacts respectively. The movable and fixed contacts constitute three pairs of switching contacts. Furthermore, the thermally responsive plate as described above has a centrally located through hole and is disposed in the hermetic container with a support (a bolt or the like) being inserted into the hole by swaging or screwing, as disclosed by Japanese Patent Application Publication No. JP-A-H01-279532 (prior art document 2).

The protector as described above is mounted in a hermetic housing of a hermetic electrical compressor thereby to be used as a thermal protector for a three-phase electric motor for driving the compressor, for example. In this case, the aforementioned three terminal pins are connected to neutral point side terminals of the phase windings respectively. A temperature around the thermally responsive switch exceeds a predetermined value when a temperature of refrigerant in the hermetic compressor rises to an unusually high temperature or when an abnormal current flows into the three-phase motor. The thermally responsive plate is reversed thereby to open the contacts. As a result, the AC current flowing into the three-phase motor is interrupted. Furthermore, when the temperature drops to or below the predetermined value, the thermally responsive plate returns to the former state such that the contacts are re-closed, whereupon the three-phase motor is re-energized.

DISCLOSURE OF THE INVENTION

Problem to be Overcome by the Invention

Strain resulting from reversal of the thermally responsive plate concentrates on a central part of the thermally responsive plate when the thermally responsive plate is formed into a dish shape by drawing. When the aforementioned through-hole is formed in the central part of the thermally responsive plate, strain resulting from reversal of the thermally responsive plate concentrates around the through-hole, resulting in a problem that cracks starting from the through-hole occur. Furthermore, the central part of the thermally responsive plate formed into the dish shape by drawing is subjected to a largest deformation during reversal and return of the thermally responsive plate. Accordingly, the movement of the part subjected to the largest deformation during the reversal and return is limited when the thermally responsive plate formed with the central through-hole is fixed to the support by means of swaging, screwing or the like.

Accordingly, an original reversing characteristic of the thermally responsive switch cannot be maintained in the conventional construction, whereupon the AC current flowing into the three-phase motor cannot be interrupted precisely.

An object of the present invention is to provide a protector for a three-phase motor, which can maintain the original reversal characteristic and can interrupt the AC current flowing into the three-phase motor precisely.

Means for Overcoming the Problem

The present invention provides a protector for a three-phase electric motor, comprising a hermetic container including a housing made of a metal and a metal plate hermetically secured to an open end of the housing; a protrusion provided in the housing; three conductive terminal pins inserted through three through holes formed in the metal plate and hermetically fixed by an electrically insulating filler respectively; three fixed contacts secured to ends of the conductive terminal pins protruding into the hermetic container respectively; a thermally responsive plate formed into a dish shape by drawing so as to reverse a direction of curvature at a predetermined temperature; three movable contacts which are secured to the thermally responsive plate so as to be opposed to the fixed contacts respectively, thereby constituting three pairs of switching contacts together with the fixed contacts; an elastic member holding a central part of the thermally responsive plate between the protrusion and the elastic member, thereby biasing the thermally responsive plate in such a direction that the thermally responsive plate departs from the fixed contacts; and a rotation preventing member which prevents the thermally responsive plate from rotation about a central part of the thermally responsive plate, thereby maintaining the movable contacts in an opposed state with respect to the fixed contacts respectively, wherein the conductive terminal pins are terminals located at a neutral point side of phase windings of the three-phase motor respectively in use of the protector, so that an AC current flowing into the three-phase motor is interrupted.

The protrusion comprises a member made of solder.

The elastic member is fixed via a support secured to the housing.

The rotation preventing member comprises a part of the support connecting between the housing and the elastic member.

Effect of the Invention

According to the protector for the three-phase motor, the thermally responsive plate is held between the protrusion and the elastic member. This eliminates the through-hole conventionally formed in the thermally responsive plate for the purpose of fixing the thermally responsive plate. Consequently, the thermally responsive plate can maintain the original reversing characteristic, and the AC current flowing into the three-phase motor can be interrupted precisely.

EXPLANATION OF REFERENCE SYMBOLS

Reference symbol 1 designates a protector for a three-phase motor, 5 a three-phase electric motor, 5A, 5B and 5C terminals at the neutral point side of phase windings of the three-phase motor, 21 a hermetic container, 22 and 41 a housing, 23 a metal plate, 23A a through-hole, 26 conductive terminal pins, 27 fixed contacts, 28 a filler, 29 a solder pellet (a member comprising solder), 31 a spring support (a support), 31B a connecting portion (a rotation preventing member, a part of the support connecting between the housing and an elastic member), 32, 43, 52 a thermally responsive plate, 33 movable contacts, 34 a spring member (an elastic member), 43B an outwardly extending part (the rotation preventing member) and 51 a holder (the rotation preventing member).

BEST MODE FOR CARRYING OUT THE INVENTION

Figure 6:
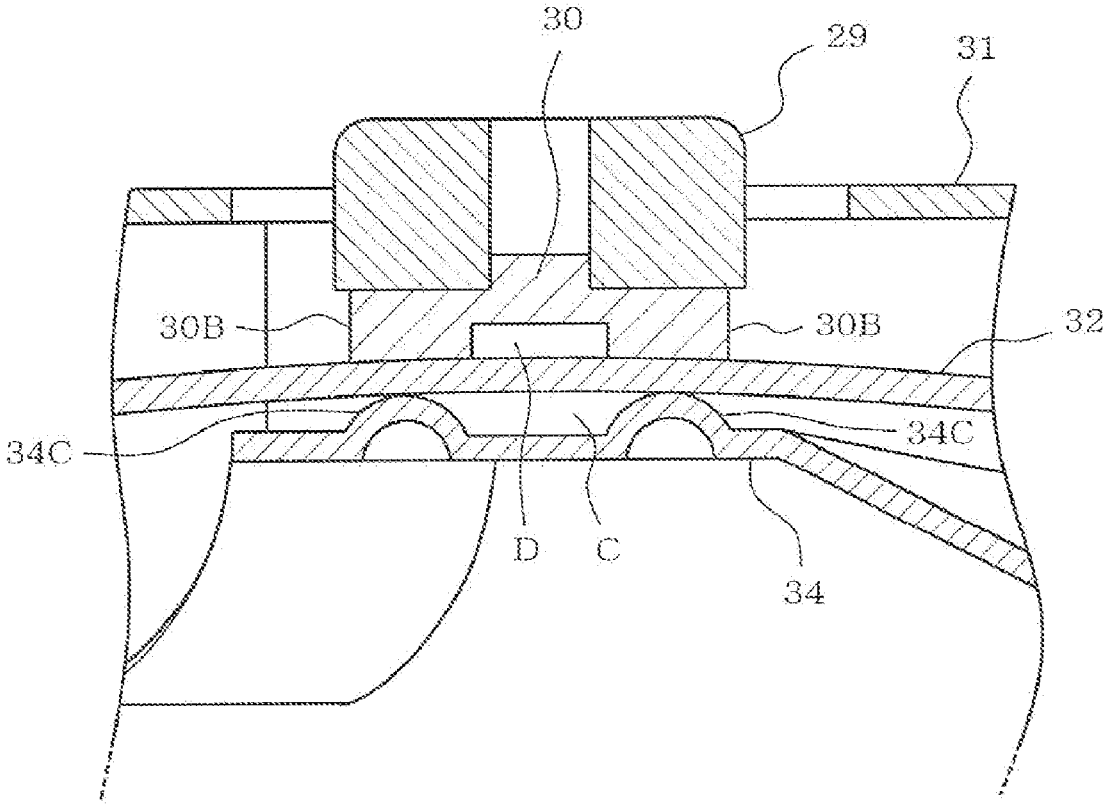
FIG. 6 is an enlarged longitudinal side section of a central part and its peripheral part of the thermally responsive plate.
Figure 7:
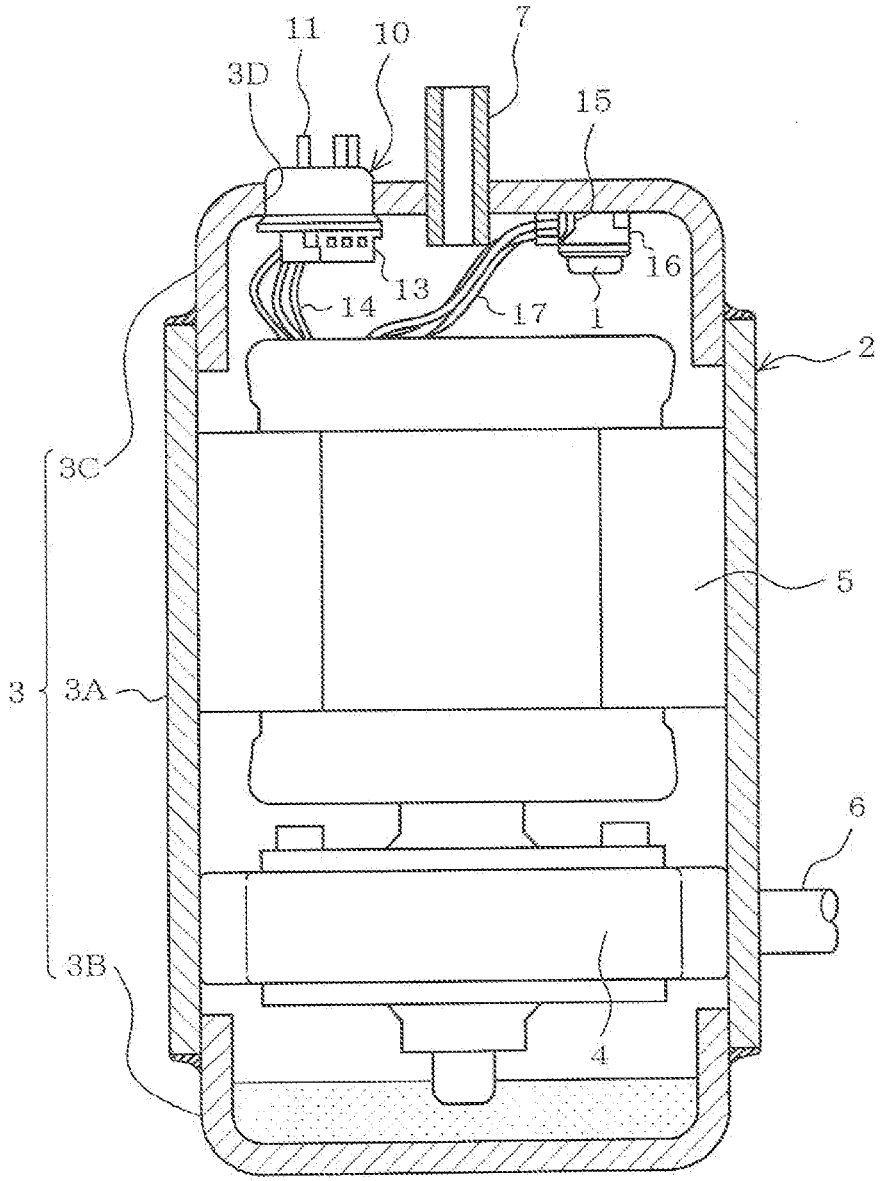
FIG. 7 is a longitudinal side section of an example of hermetic electric compressor.

A first embodiment will be described with reference to FIGS. 1 to 10B. FIG. 7 shows an example of a vertical hermetic rotary compressor 2 which is provided with a protector 1 for a three-phase electric motor, according to the embodiment. The compressor 2 is of a high pressure type in which an entire compressor housing 3 made of a metal serves as a passage for a refrigerant discharged. The compressor housing 3 comprises a central part 3A having upper and lower ends which are open, a housing end 3B hermetically covering a lower end side of the central part 3A and a housing end 3C hermetically covering an upper end side of the central part 3A.

The compressor housing 3 accommodates a rotary compressing unit 4 and a three-phase electric motor 5 therein. The rotary compressing unit 4 is disposed at the housing end 3B side in the central part 3A. The rotary compressing unit 4 comprises a housing (not shown) and a rotor (not shown). The rotor is driven via a crank (not shown) and a drive shaft (not shown) by the three-phase motor 5. The three-phase motor 5 is disposed at the housing end 3C side in the central part of the compressor housing 3.

The compressor housing 3 has a side provided with a suction pipe 6 and an upper part provided with a discharge pipe 7. The suction pipe 6 is inserted through the side of the compressor housing 3 to be hermetically fixed. The suction pipe 6 is further connected to the rotary compressing unit 4 to supply sucked refrigerant into the rotary compressing unit 4. The discharge pipe 7 is inserted through an upper end of the compressor housing 3 to be hermetically fixed. The refrigerant compressed by the rotary compressing unit 4 is supplied through an interior of the compressor housing 3 and the discharge pipe 7 into a freezing unit (not shown). The interior of the compressor housing 3 is filled with lubricating oil.

A through hole 3D is provided in the compressor housing 3 or in a part thereof constituted by the housing end 3C. A hermetic conductive terminal 10 is hermetically secured in the through hole 3D in order to electrically connect between the interior and an exterior of the compressor housing 3. The terminal 10 includes a body made of a metal and a plurality of or, in this case, three conductive terminal pins 11 extending through the body.

The terminal pins 11 are insulated and hermetically fixed by an electrically insulating filler (not shown) comprising glass or the like in view of a thermal expansion coefficient by a well-known hermetic compression sealing. The terminal pins 11 have one ends (ends at the outside of the compressor housing 3 connected to a power supply 12 (see FIG. 9) and the other ends (ends at the inside of the compressor housing 3) inserted into sockets 13, respectively. The sockets 13 are connected via three leads 14 to the three-phase motor 5.

Figure 8:
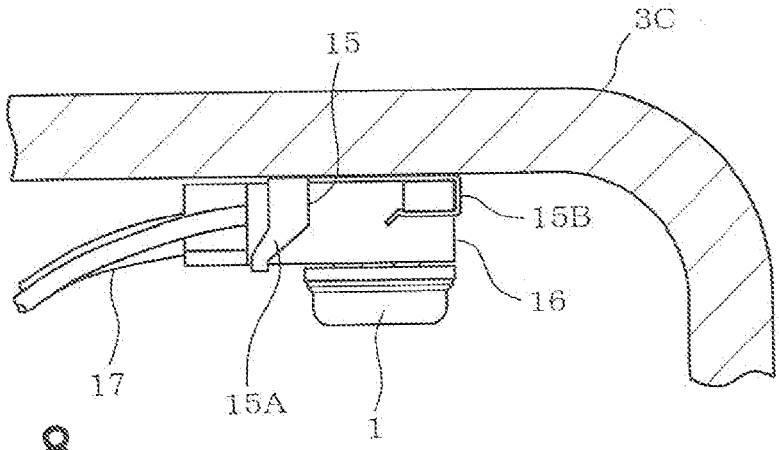
FIG. 8 is an enlarged longitudinal side section of a part of the protector where a cluster socket is mounted.
Figure 9:
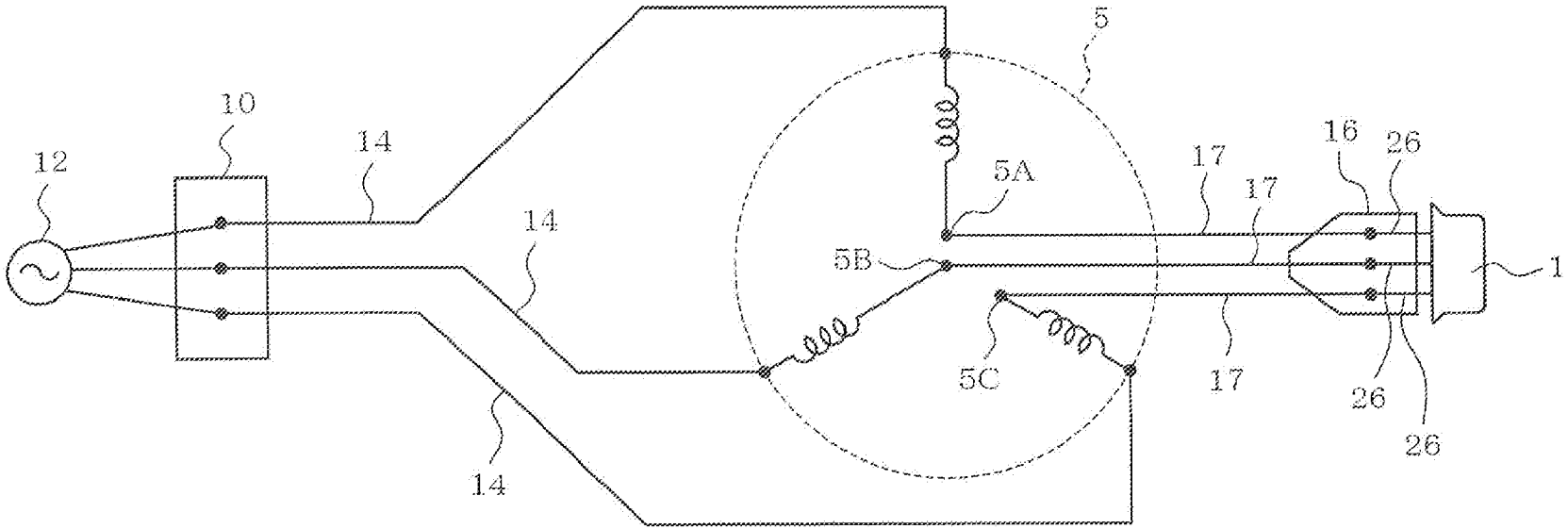
FIG. 9 shows connection between the three-phase motor and the protector.
Figure 10A:
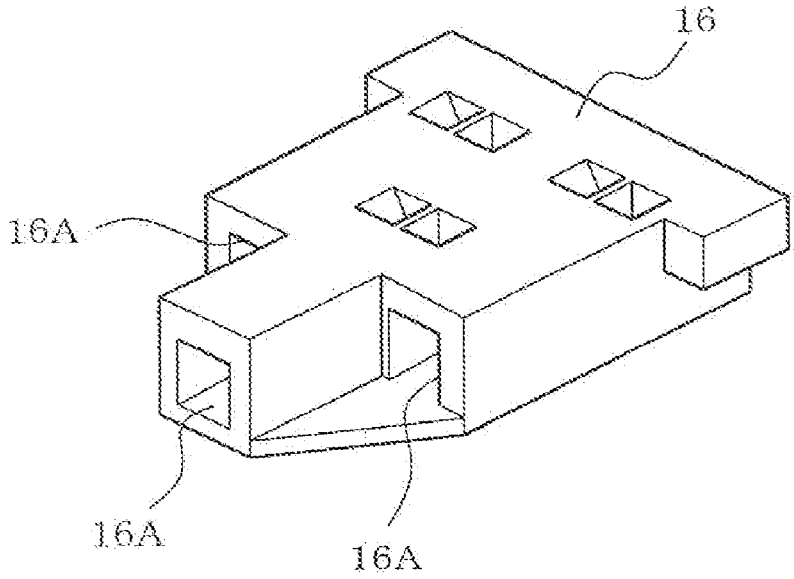
FIG. 10A is a perspective view showing an upper side of the cluster socket.
Figure 10B:
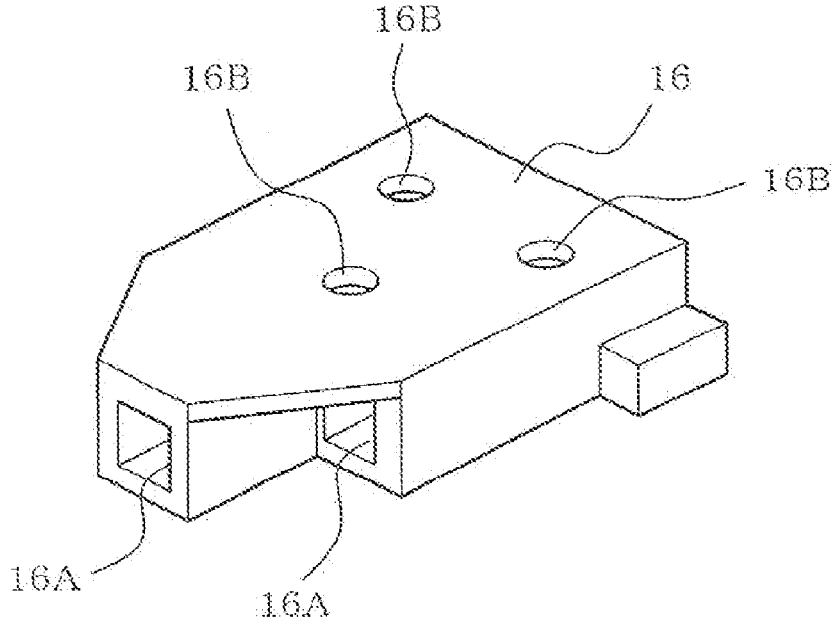
FIG. 10B is a perspective view showing a lower side of the cluster socket.

A cluster socket 16 is fixed via a fixing bracket 15 to an inner wall of the compressor housing 3. The cluster socket 16 is fitted with support strips 15A and 15B of the fixing bracket 15 as also shown in FIG. 8. The cluster socket 16 has three rectangular insertion holes 16A (see FIG. 10A) which are open in a lengthwise direction. Furthermore, the cluster socket 16 has a bottom formed with three circular insertion slots 16B (see FIG. 10B). The insertion slots 16B are located so as to be equally spaced from one another thereby to form a triangle with equally-spaced sides according to standards.

Three leads 17 (see FIG. 7) drawn from the three-phase motor 5 are inserted into the insertion holes 16A to be fixed, respectively. The leads 17 are connected to terminals 5A to 5C (see FIG. 9) located at the neutral point side of the phase windings of the three-phase motor 5 respectively. The protector 1 which will be described in detail later has three conductive terminal pins 26 insertable into the insertion holes 16B of the cluster socket 16 respectively.

Figure 1:
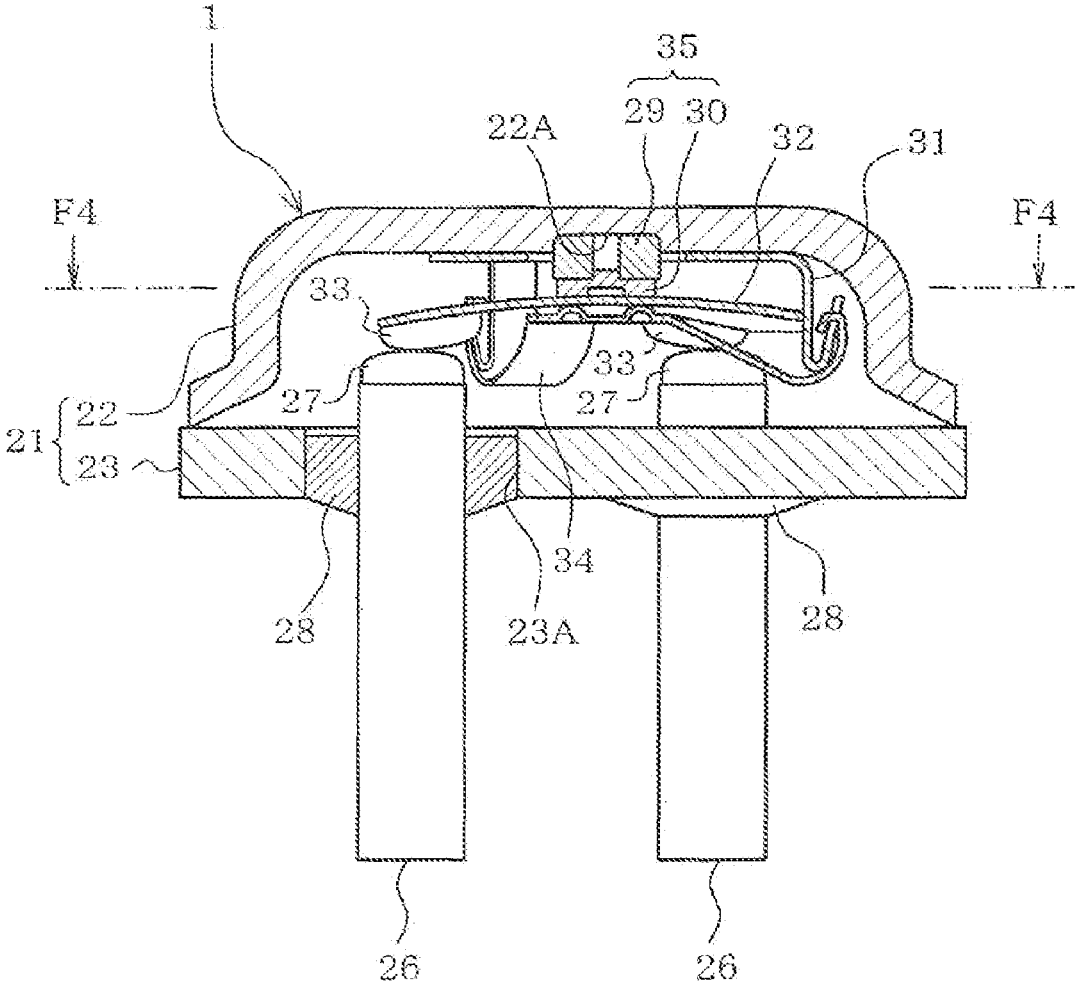
FIG. 1 is a longitudinal side section of the protector for the three-phase motor in accordance with a first embodiment.

The arrangement and construction of the protector 1 will now be described. FIG. 1 is a longitudinal side section of the protector 1. The protector 1 includes a hermetic container 21 constituted by a metal housing 22 formed by drawing a steel plate by a press machine and a metal plate 23 hermetically secured to an open end of the housing 22 by the ring projection welding or the like. The protector 1 has a contact switching mechanism that is provided in the hermetic container 21 and uses a thermally responsive plate 32. The protector 1 is used to interrupt an AC current flowing into the motor 5.

Figure 2:
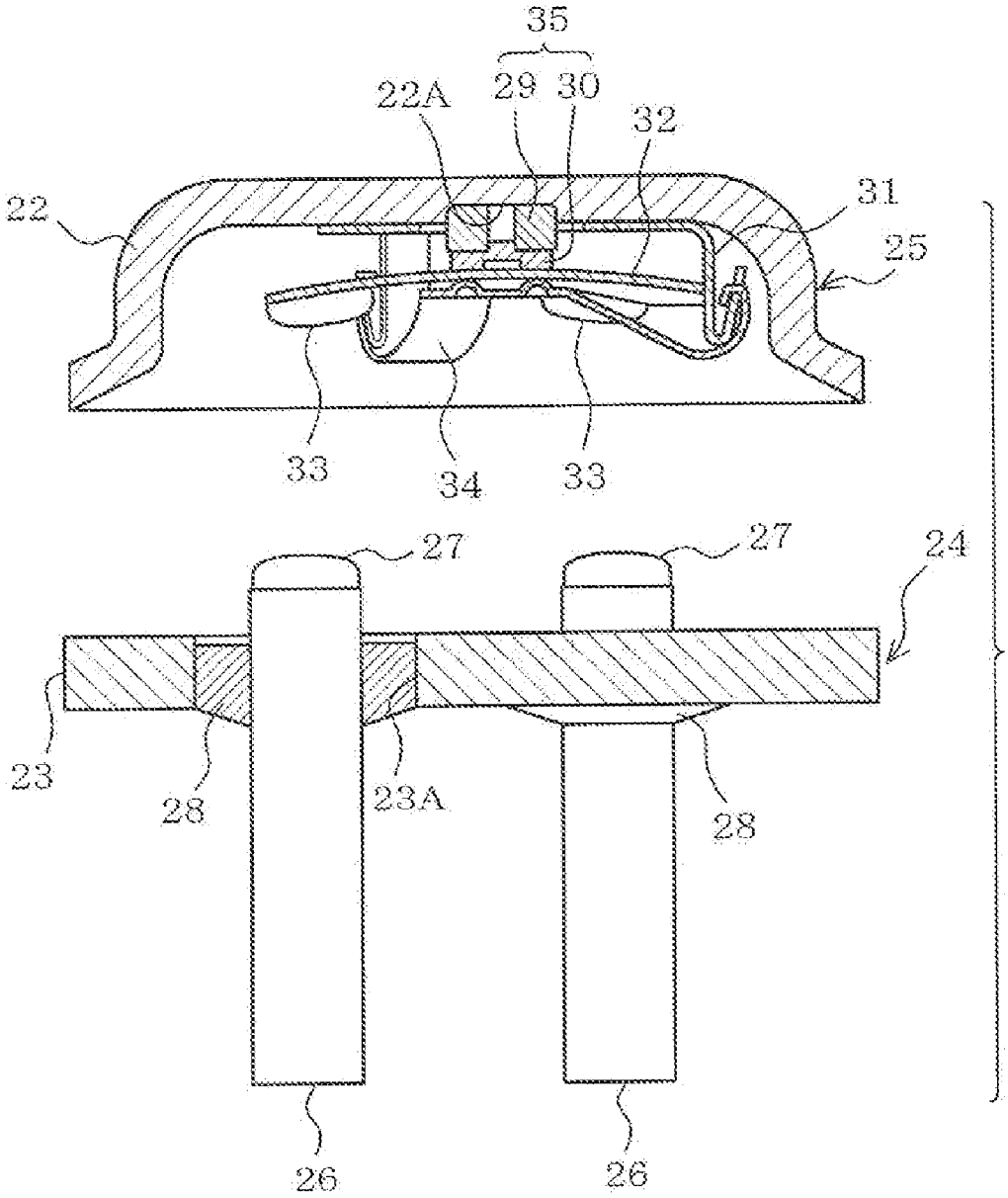
FIG. 2 is a longitudinal section of a metal plate assembly and a housing assembly.

The protector 1 includes a metal plate assembly 24 and a housing assembly 25 as shown in FIG. 2. The metal plate assembly 24 includes a metal plate 23, three conductive terminal pins 26 (only two are shown in FIG. 2) and three fixed contacts 27 (only two are shown in FIG. 2). The metal plate 23 is formed so as to be thicker than the housing 22 and is further formed into the shape of a triangle having a smooth periphery. The metal plate 23 has three through-holes 23A which are located so as to be equally spaced from one another and forms a triangle with equally-spaced sides.

The terminal pins 26 are inserted through the holes 23A of the metal plate 23 respectively to be insulated and hermetically fixed by an electrically insulating filler 28 comprising glass or the like in view of a thermal expansion coefficient by a well-known hermetic compression sealing. The fixed contacts 27 are secured to ends of the terminal pins 26 protruding into the hermetic container 21, by welding, respectively. Each fixed contact 27 contains an oxidized metal and has a disc-like shape. Each fixed contact 27 has a contact surface which is slightly convexly curved (spherical surface).

Figure 3:
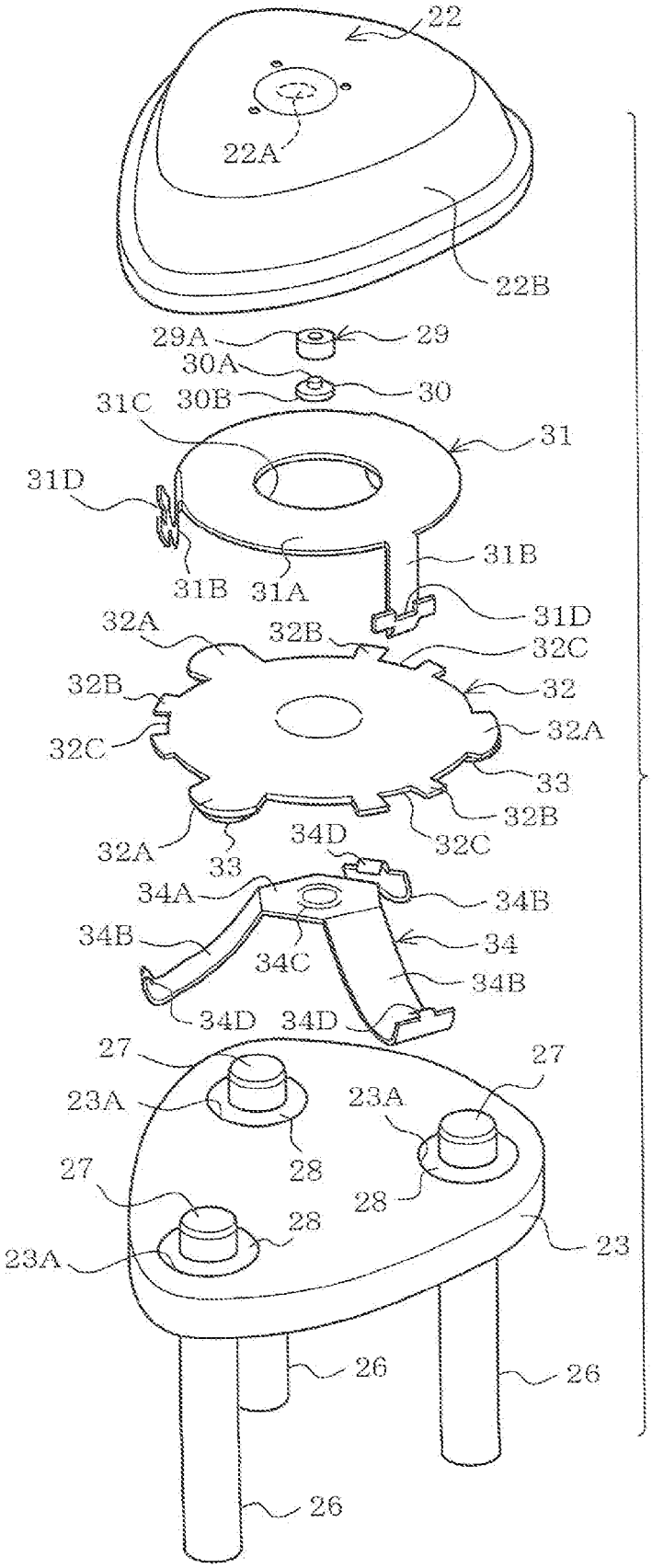
FIG. 3 is an exploded perspective view of the protector.
Figure 4:
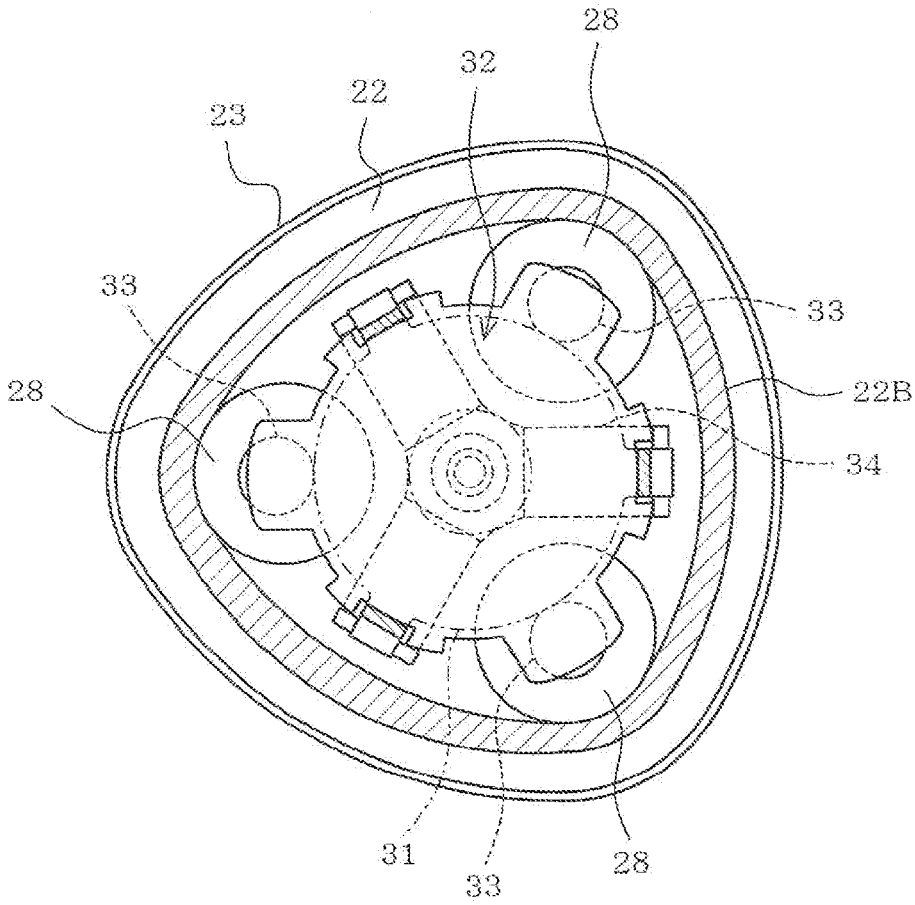
FIG. 4 is a cross-sectional view of the protector.
Figure 5:
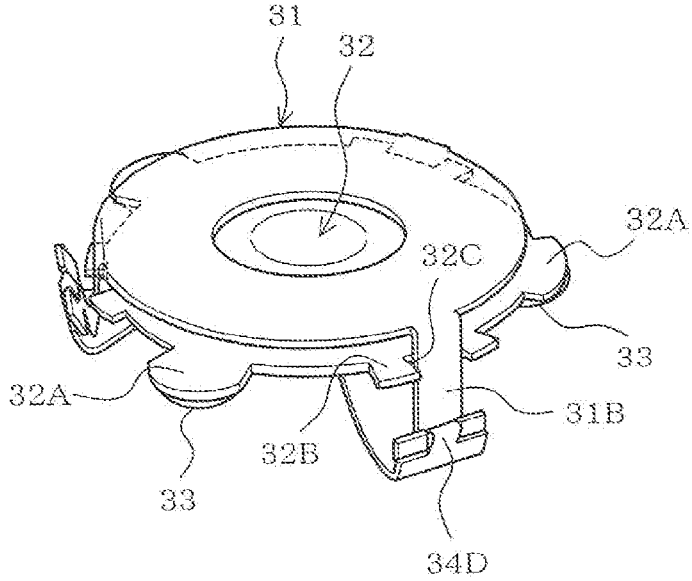
FIG. 5 is a perspective view showing a spring support, a thermally responsive plate and a spring member all of which are assembled together.

On the other hand, the housing assembly 25 includes a housing 22, a solder pellet 29, a protecting plate 30, a spring support member 31, a thermally responsive plate 32, three movable contacts 33 (only two movable contacts are shown in FIG. 2) and a spring member 34. The housing 22 is formed into a smooth triangular shape and has an outer peripheral edge slightly smaller than the periphery of the metal plate 23 as shown in FIG. 3. Furthermore, the terminal pins 26 and the fixed contacts 27 of the metal plate assembly 24 are adapted to be housed in a space surrounded by a sidewall 22B of the housing 22, as shown in FIG. 4 that is a transversely sectional plan view of the protector 1 taken along line F4-F4 in FIG. 1). The housing 22 has a downwardly open circular recess 22A (see FIG. 3) formed in a central inside thereof.

The solder pellet 29 is formed by punching a plate-shaped material comprising solder (containing no lead) and has a central part formed with an insertion hole 29A (see FIG. 3A), thereby being formed into the shape of a flat ring. The protecting plate 30 has a protrusion 30A (see FIG. 3) which is insertable into the insertion hole 29A as will be described later. The solder pellet 29 has a melting temperature that is set to be equal to or higher than a reversing temperature (100° C. in the embodiment) of the thermally responsive plate 32, so as to be as low as possible (220° C. to 250° C., for example), as will be described later.

The protecting plate 30 is formed by drawing a copper plate or the like by a press machine and has a cylindrical protrusion 30A and an annular flange 30B extending from an open circumferential end of the protrusion 30A. The spring support member 31 has a fixing portion 31A and three connecting portions 31B extending downward from an outer edge of the fixing portion 31A, as shown in FIG. 3. The fixing portion 31A is formed into an annular shape and has a centrally located circular opening 31C. The three connecting portions 31B are disposed equiangularly along an outer circumference of the fixing portion 31A. The connecting portions 31B have distal ends which are curved upward and formed with rectangularly notched engaged portions 31D, respectively.

The thermally responsive plate 32 comprises a thermally deformable member such as a bimetal or a trimetal and is generally formed into a disc. The thermally responsive plate 32 is formed into the shape of a shallow dish by drawing and designed to reverse a direction of curvature with a snap action when having reached a predetermined reverse temperature (100° C. in the embodiment). The thermally responsive plate 32 is further designed to return to its original direction of curvature when having dropped to or below the reverse temperature.

The thermally responsive plate 32 has three extending portions 32A which are formed on outer edge thereof so as to be disposed equiangularly along a periphery and so as to extend outward. The thermally responsive plate 32 further has three protrusions 32B which are formed equiangularly along the periphery of the thermally responsive plate 32 so as to be located between the extending portions 32A and so as to extend outward. Each protrusion 32B is located in the middle between the extending portions 32A and has a rectangular notch 32C formed in the middle thereof.

The movable contacts 33 are secured to the undersides of the extending portions 32A of the thermally responsive plate 32 (portions opposed to the fixed contacts 27 inside the hermetic container 21 respectively) by welding respectively. Each movable contact 33 contains an oxidized metal and is formed into a disc shape. Each movable contact 33 has a contact surface which is slightly convexly curved (spherical).

The spring member 34 has a support 34A and three leaf springs 34B extending from an outer edge of the support 34A. The support 39A has a ring-shaped protrusion which is formed on a central part thereof and protrudes upward. The leaf springs 39B are disposed equiangularly on the outer edge thereof. Each leaf portion 39B has a distal end which is curved upward and provided with an inwardly folded engaging portion 34D.

The housing assembly 25 comprising the above-described members will be assembled in the following manner. Firstly, an upper surface of the fixing portion 31A of the spring support 31 is secured to the underside of the housing 22 by welding. In this case, the welding is carried out while the spring support 31 is disposed inside the housing 22 so that the recess 22A of the housing 22 lies centrally in the opening 31 of the fixing portion 31A. Then, the solder pellet 29 is inserted into the recess 22A, and the protecting plate 30 is placed below the underside of the solder pellet 29 having inserted in the recess 22A. In this case, the protrusion 30A of the protecting plate 30 is inserted into the insertion hole 29A of the solder pellet 29. This results in the forming of a protrusion 35 (see FIG. 1) comprising the solder pellet 29 and the protecting plate 30 is formed.

Next, the thermally responsive plate 32 is placed below the underside of the protecting plate 30 (the protrusion 35) with the top of the curved portion thereof being directed upward. In this case, the central upper surface of the thermally responsive plate 32 is abutted against the underside of the protecting plate 30. Furthermore, the fixed contacts 33 secured to the respective extending portions 32A of the thermally responsive plate 32 are placed at the middle portions between the connecting portions 31B of the spring support respectively (see FIG. 5). Furthermore, the connecting portions 31B of the spring support member 31 are fitted into the notches 32C of the thermally responsive plate 32 respectively (see FIG. 5).

The spring member 34 is then placed below the thermally responsive plate 32, and the central protrusion 34C of the spring member 34 is abutted against the central underside of the thermally responsive plate 32. The engagement portions 34D of the spring member 34 are engaged with the engaged portions 31D of the spring support 31 respectively (see FIG. 5). As a result, the housing assembly 25 is assembled in which the central part of the thermally responsive plate 32 is integrated into the housing 22 while being held between the protrusion 35 and the spring member 34.

A part of the housing assembly 25 secured by welding is only one contact portion between the housing 22 and the spring support member 31. The components are adjacent to each other but are not secured to each other in the other inter-component contact portions (the portions between the housing 22 and the solder pellet 29, between the solder pellet 29 and the protecting plate 30, between the protecting plate 30 and the thermally responsive plate 32 and between the thermally responsive plate 32 and the spring member 34).

The metal plate 23 of the metal plate assembly 24 constructed above and the open end of the housing 22 of the housing assembly are hermetically welded together with a gas with a predetermined pressure filling the interior, whereby the protector 1 is assembled. Three pairs of switching contacts 27 and 33 each comprising the fixed and movable contacts 27 and 33 are formed between the conductive terminal pins 26 and the thermally responsive plate 32 in the protector 1 as assembled above. As a result, electrical paths are formed which comprise the three conductive terminal pins 26, the three paired switching contacts 27 and 28 and the thermally responsive plate 32 in the interior of the protector 1.

The thermally responsive plate 32 is biased in such a direction that the thermally responsive plate 32 departs from the fixed contacts 27. Furthermore, the central part of the thermally responsive plate 32 has the underside pressed against the upper end of the protrusion 34C of the spring member 34 and the upper surface pressed against the flange 30B of the protecting plate 30, as shown in FIG. 6. More specifically, the upper surface and the underside of the central part of the thermally responsive plate 32 are pressed against the ring portions (the protrusion 34C and the flange 30B). Accordingly, the central part of the thermally responsive plate 32 surrounded by the protrusion 34A and the flange 30B is movable when the thermally responsive plate 32 is reversed without being restricted in the inner space D of the flange 30B. Consequently, influences of the fixed portions on the operation of the thermally responsive plate 32 can be reduced, and the thermally responsive plate 32 can be designed as a thermal protector so as to take advantage of the original reversing characteristic.

Furthermore, the spring support 31 has the three connecting portions 31B connecting between the housing 22 and the spring member 34. The connecting portions 31B are fitted in the notches 32C of the thermally responsive plate 32 thereby to be held between the split portions of the respective protrusions 34C. This prevents the thermally responsive plate 32 from being rotated about a central part thereof (the part held between the protrusion 35 and the protrusion 34C of the spring member 34). Furthermore, the thermally responsive plate 32 has three equally-spaced portions which are formed in the outer edge thereof and pressed by the connecting portions 31B respectively. As a result, the thermally responsive plate 32 is prevented from horizontal movement. Thus, the thermally responsive plate 32 is prevented from the circumferential rotation and the horizontal movement. Consequently, three pairs of switching contacts 27 and 33 in which three movable contacts are vertically opposed to three fixed contacts 27 in the hermetic container 21 of the protector 1.

Furthermore, the solder pellet 29 has the upper portion inserted in the recess 22A of the housing 22 and the lower portion (the insertion hole 29A) in which the protrusion 30A is inserted, whereby the solder pellet 29 is adapted to be positioned in the vertical and horizontal directions.

The three conductive terminal pins 26 are inserted into the three insertion holes 16B of the cluster socket 16 respectively so that the protector 1 thus constructed is mounted on the hermetic electrically-driven compressor 2. The terminal pins 26 are connected to the lead wires 17 in the cluster socket 16, whereby the terminal pins 26 of the protector 1 are connected via the lead wires 17 to the neutral point side terminals 5A to 5C of the phase windings of the three-phase motor 5 respectively. More specifically, the protector 1 is disposed at the neutral point of a star connection (a Y-connection) thereby to serve as a neutral point of the three-phase motor 5.

Under the condition that the temperature of the refrigerant in the hermetic compressor 2 is abnormally high or that an abnormal current flows into the three-phase motor 5, the thermally responsive plate 32 is reversed thereby to open the switching contacts 27 and 33 when the temperature in the protector 1 exceeds the reversing temperature of the thermally responsive plate 3, with the result that power supplied to the three-phase motor 5 is interrupted. Furthermore, when the refrigerant temperature drops to or below a predetermined value or when the electric current value of the motor 5 is reduced to or below a predetermined value such that the temperature in the protector 1 drops to or below the reversing temperature of the thermally responsive plate 32, the thermally responsive plate 32 is recovered to its original state such that the switching contacts 27 and 33 are re-closed, with the result that the motor 5 is energized.

The operation current of the motor 5 does not raise the thermally responsive plate 32 to the reversing temperature during a normal operation of the rotary compressor 4 which is equipment to be controlled. Furthermore, when the motor 5 is under a locked-rotor condition, the thermally responsive plate 32 is reversed in response to heat generated by the thermally responsive plate 32 constituting part of the electric path thereby to open the switching contacts 27 and 33 in a short period of time. In this case, the heat generated by the thermally responsive plate 32 is radiated to the housing 22 via the protrusion 35 which is in direct contact with the thermally responsive plate 32. Accordingly, the thermally responsive plate 32 is prevented from abnormal heat generation.

For example, the fixed and movable contacts 27 and 33 are sometimes welded together thereby to be inseparable when the protector 1 repeats closure and opening of the switching contacts 27 and 33 for a long period of time to exceed a guaranteed number of switching operations. When the rotor (not shown) of the motor 5 is locked in this case, the temperature of the thermally responsive plate 32 (the temperature of the central portion thereof, particularly) is increased by an overcurrent. Heat is transferred via the protecting plate 30 to the solder pellet 29. Although part of the heat transferred to the solder pellet 29 is radiated to the housing 22, heat is continuously generated by the thermally responsive plate 32 in the state where the switching contacts 27 and 33 are welded together. When the thermally responsive plate 32 abnormally produces heat, the solder pellet 29 reaches its melting temperature thereby to be melted such that the protrusion 35 holding the thermally responsive plate 32 is lost. In this state, since the thermally responsive plate 32 is further biased by the spring member 34 in such a direction as to depart from the fixed contact 27, the welded switching contacts 27 and 33 are opened substantially simultaneously. Consequently, power supplied to the motor 5 can reliably be interrupted.

According to the above-described protector 1 for the three-phase motor, the thermally responsive plate 32 includes the central part held between the protrusion 35 provided in the housing 22 and the spring member 34. This can eliminate the through hole which has conventionally been provided for fixing the thermally responsive plate. Accordingly, the thermally responsive plate 32 can be provided while the original reversing characteristic is retained, and the AC current flowing into the motor 5 can accurately be interrupted.

Furthermore, since the protector 1 is provided for the three-phase motor has no through hole formed in the thermally responsive switch, there is no possibility of occurrence of crack or the like around the through hole, and the original reversing characteristic of the thermally responsive plate 32 can be prevented from being damaged.

Furthermore, a part of the protrusion 35 holding the thermally responsive plate 23 is composed of the solder pellet (the member comprising solder). When the thermally responsive plate 32 abnormally generates heat as the result of welding of the switching contacts 27 and 33, a part of the protrusion 35 holding the thermally responsive switch is melted such that the thermally responsive switch 1 looses the protrusion 35 holding the thermally responsive plate 32. In this state, however, the thermally responsive plate 32 is biased in such a direction as to be departed from the fixed contact 27. Consequently, the switching contacts 27 and 33 welded together can be opened.

Furthermore, the spring member 34 holding the thermally responsive plate 32 is fixed via the spring support 31 secured to the housing 22. This construction can integrate the thermally responsive plate 32 with the housing 22 while the thermally responsive plate 34 is held between the protrusion 35 and the spring member 34. Consequently, the protector 1 can be manufactured easily.

Additionally, the spring support 31 includes a part (the connecting part 31B) connecting between the housing 22 and the spring member 34. The thermally responsive plate 32 is configured to be prevented from rotation about the central part of the thermally responsive plate 32 by making use of the connecting part. Accordingly, since no new member needs to be provided as a member for prevention of rotation of the thermally responsive plate 32, the protector 1 for the three-phase motor can be manufactured without increase in the number of components.

Second Embodiment

Next, a second embodiment will be described with reference to FIGS. 11 and 12. In the second embodiment, a part of the thermally responsive plate 43 is abutted against the inner circumferential surface 41C of the housing 41, so that the thermally responsive plate 43 is prevented from circumferential rotation.

Figure 11:
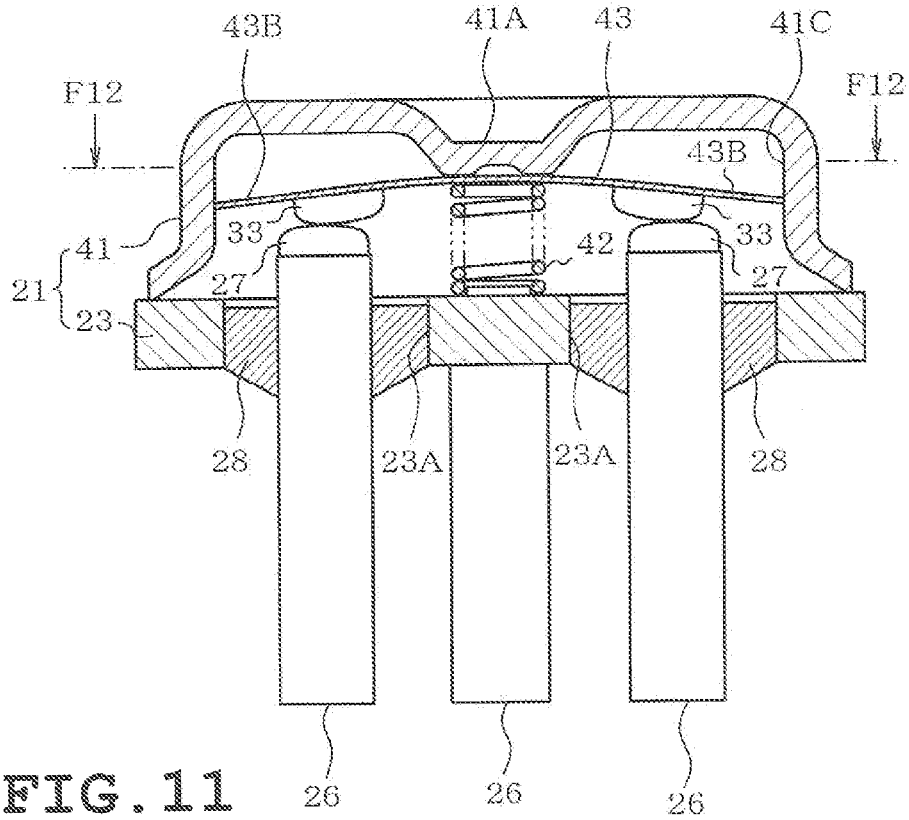
FIG. 11 is a view similar to FIG. 1, showing a second embodiment.

A protrusion 41A is provided on a central part of the housing 41 as shown in FIG. 11. The protrusion 41A is drawn by a press machine. A coil spring 42 is supported on the central part of the metal plate 23. The thermally responsive plate 43 is held at a central part thereof between the coil spring 42 and the protrusion 41A so that the coil spring 42 biases the thermally responsive plate 43 in such a direction that the thermally responsive plate 43 is departed from the fixed contacts 27.

Figure 12:
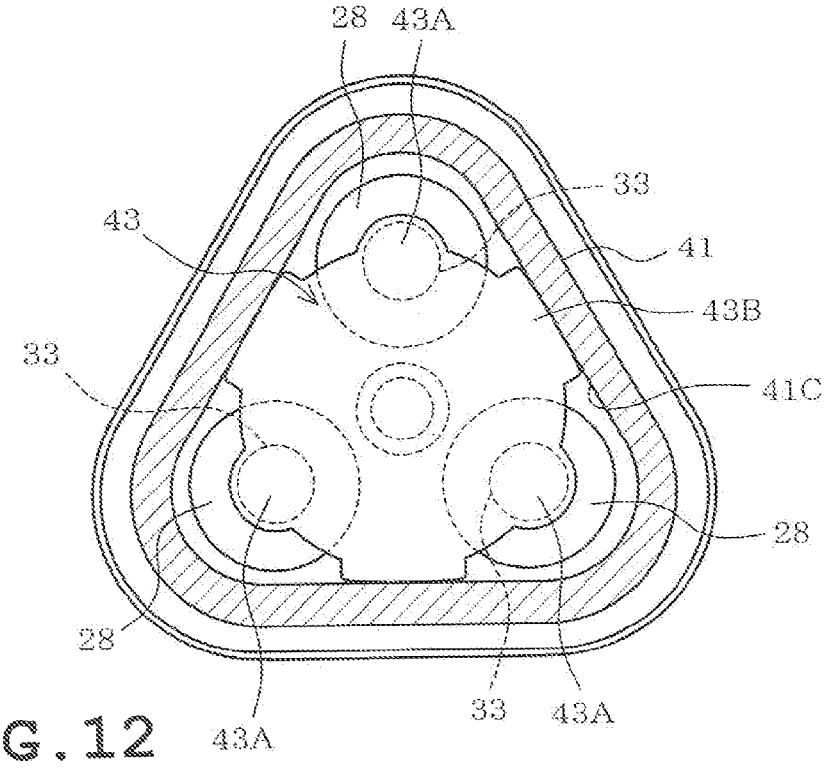
FIG. 12 is a view similar to FIG. 4.

An outer edge of the thermally responsive plate 43 is formed with three rectangular outwardly extending portions 43B located in the middle between the three projections 43A to which the movable contacts 33 are secured, respectively, as shown in FIG. 12. The extending portions 43B have respective distal ends which are opposed to the inner circumferential surface 91C of the housing 41 with slight gaps (not shown) therebetween.

According to the above-described construction, the extending portions 43B are abutted against the inner circumferential surface 41C of the housing 41 thereby to prevent the thermally responsive plate 43 from rotation about the central portion of the thermally responsive plate 43 and further from horizontal movement of the thermally responsive plate 43.

Each extending portion 43B is located so as to have a slight gap between the inner circumferential surface 41C of the housing 41 and each extending portion 43B. Accordingly, each extending portion 43B can be prevented from adversely affecting the reversing characteristic of the thermally responsive plate 43 without being caught by the inner circumferential surface during reversing and recovery of the thermally responsive plate 43.

Furthermore, the extending portions 43B each having a function of preventing rotation of the thermally responsive plate 43 are provided on the respective parts of the thermally responsive plate 43. Accordingly, no new member is required for preventing rotation of the thermally responsive plate 43. Furthermore, parts of an existing member (the connecting portion 31B of the spring member 34 as shown in the first embodiment) need not be used as a member for preventing rotation of the thermally responsive plate 43. Consequently, the protector 1 for the three-phase motor can be manufactured while increase in the number of parts is further suppressed.

Third Embodiment

Figure 13:
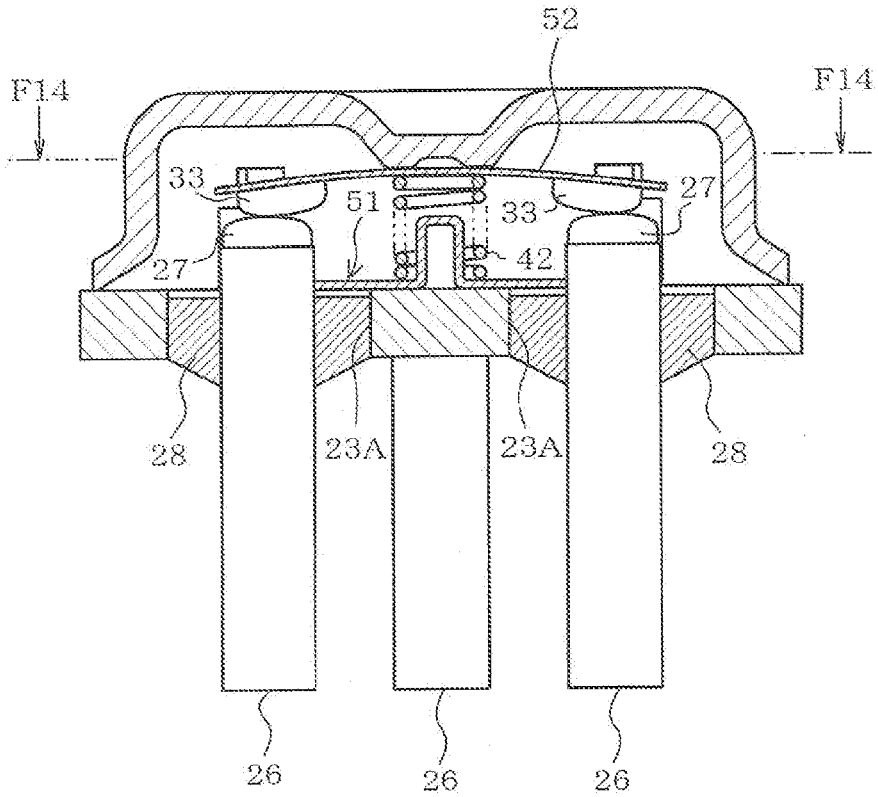
FIG. 13 is a view similar to FIG. 1, showing a third embodiment.
Figure 14:
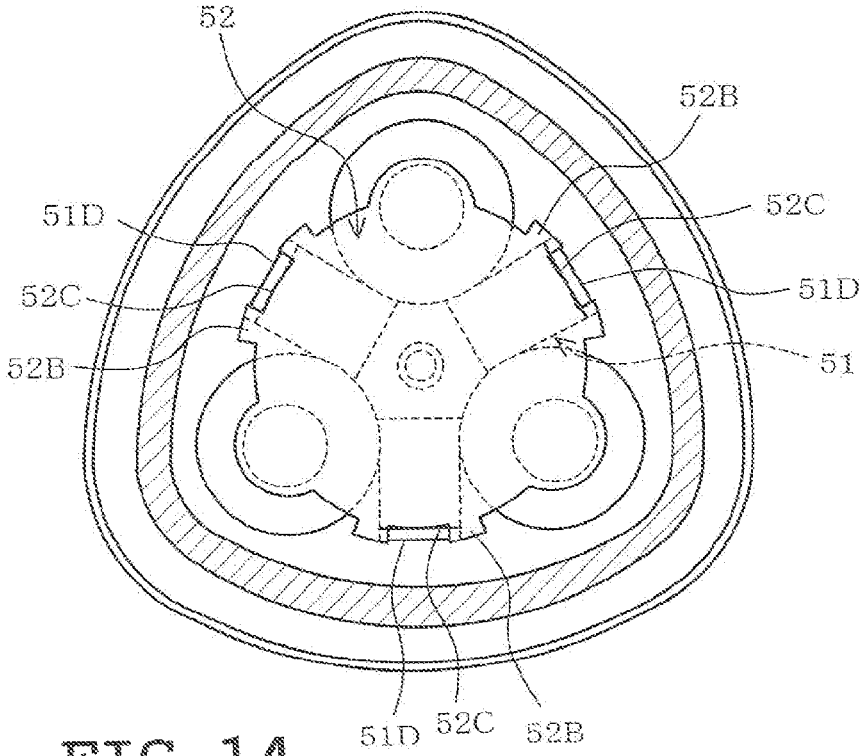
FIG. 14 is a view similar to FIG. 4.
Figure 15A:
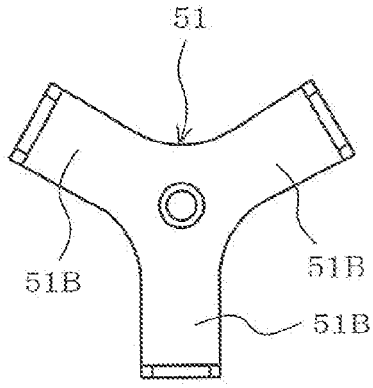
FIG. 15A is a plan view of a holder.
Figure 15B:
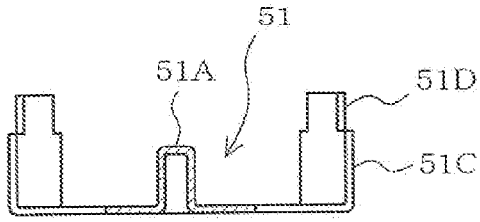
FIG. 15B is a longitudinal side section of the holder.

Next, a third embodiment will be described with reference to FIGS. 13 to 15B. The holder 51 for preventing rotation of the thermally responsive plate 52 is provided as an independent member dedicated to prevention of rotation as shown in FIGS. 13 and 14. The holder 51 has a protrusion 51A and three fixing portions 51B extending outward with the protrusion 51A serving as the center. The protrusion 51A extends upward to be formed into a columnar shape and is adapted to hold the coil spring 42 (see FIG. 13). The fixing portions 51B are circumferentially equally spaced about the protrusion 51A and have outer ends provided with respective holding portions 51C extending upward in the shape of a plate. The holding portions 51C have respective protrusions 51D protruding upward in a rectangular shape.

The fixing portions 51B of the holder 51 are secured to an upper surface of the metal plate 23 as shown in FIG. 13. As a result, the protrusion 51A of the holder 51 is disposed on the upper central surface of the metal plate 23. A coil spring 42 is held by the protrusion 51A. The protrusions 51D of the holder 51 are fitted in the notches 52C of the thermally responsive plate 52 thereby to be held by protrusions 52B respectively. As a result, the thermally responsive plate 52 can be prevented from rotation about the central portion thereof and from horizontal movement thereof.

Other Embodiments

Figure 16:
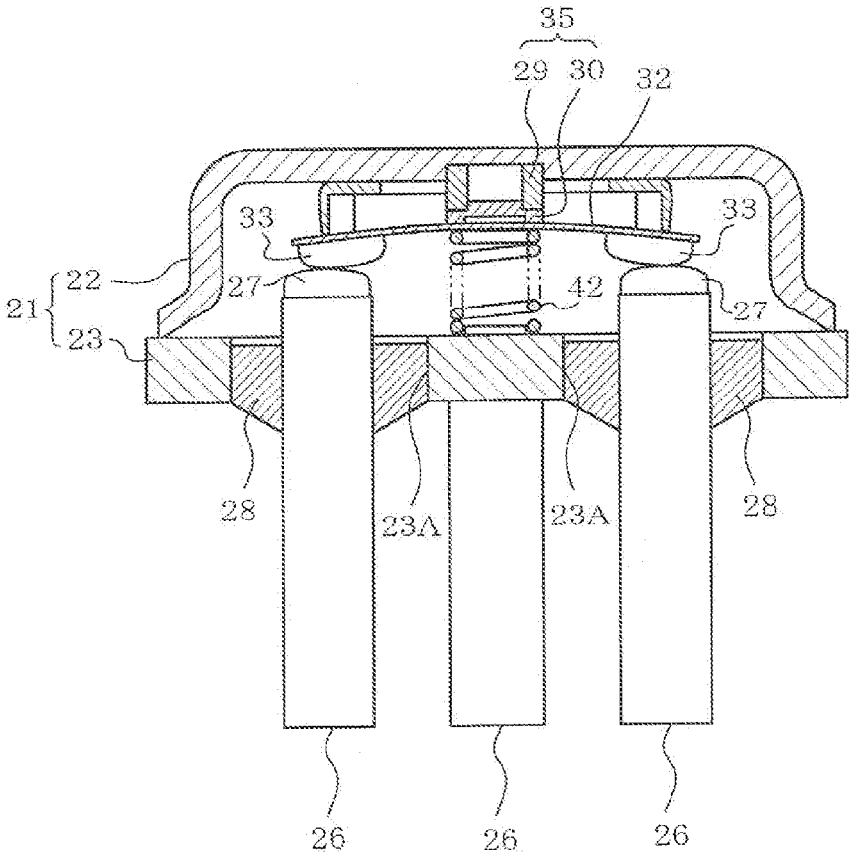
FIG. 16 is a view similar to FIG. 1, showing a modified form.

The above-described embodiments are not restrictive but may be modified as follows. The elastic member should not be limited to the spring member 34 fixed via the spring support 31 secured to the housing 22 in the first embodiment. For example, as shown in FIG. 16, a coil spring 42 may be held on the central portion of the metal plate 23, and the central portion of the thermally responsive plate 23 may be held between the coil spring 42 and the protrusion 35 so that the thermally responsive plate 32 is biased in such a direction as to be departed from the fixed contacts 27.

Figure 17:
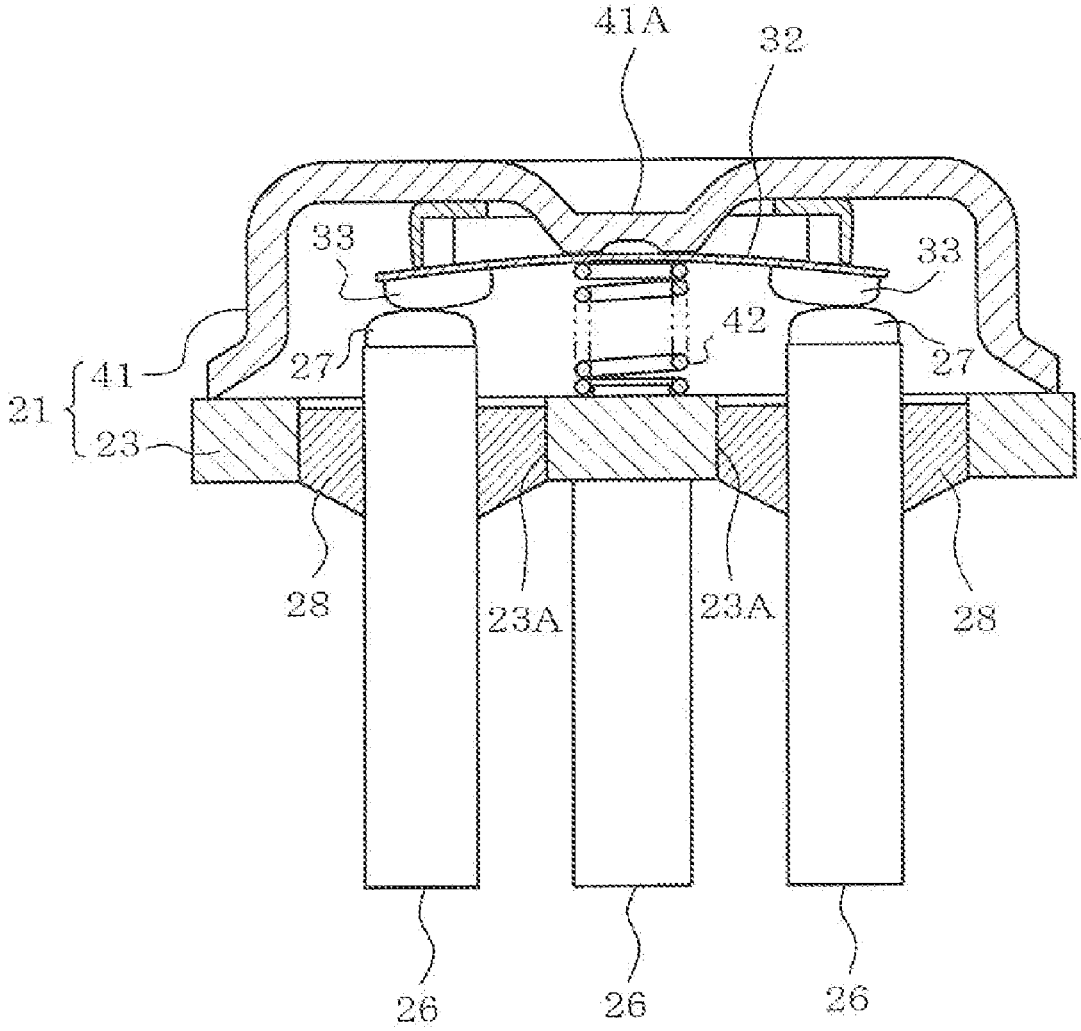
FIG. 17 is a view similar to FIG. 1, showing another modified form.

The protrusion 35 comprises the solder pellet 29 and the protecting plate 30 in the foregoing first embodiment. However, the protrusion 35 should not be limited to the above-described construction. For example, as shown in FIG. 17, a protrusion 41A may be formed by drawing a central part of the housing 41 using a press machine. Furthermore, the spring member 34 and the coil spring 42 each has a biasing force enough to open the three pairs of switching contacts 27 and 33 welded substantially simultaneously. However, the spring member 34 and the coil spring 42 should not be limited to the above-described biasing force but may each have a biasing force enough to open at least two of the three pairs switching contacts 27 and 33, instead.

The three-phase motor protector 1 may be provided for use with horizontal sealed compressors as well as the vertical sealed compressor 2. Furthermore, the protector may be provided for use with a sealed compressor of the low-pressure housing type in which the three-phase motor 5 is disposed in a low pressure section or at the suction side, and the rotary compressor 4 may be disposed in a high-pressure section or at the discharge side. Furthermore, the compressor should not be limited to the rotary type but may be of a scroll type or of another type. Additionally, the protector may be provided for use with marine engines.

INDUSTRIAL APPLICABILITY

As described above, according to the present invention, the through hole conventionally provided for fixing the thermally responsive plate is rendered unnecessary, whereby the original reversing characteristic of the thermally responsive plate can be retained. Accordingly, the protector is useful as a thermal protector for three-phase motors for sealed compressors, for example.

The invention claimed is:

1. A protector for a three-phase electric motor, comprising:

a hermetic container including a housing made of a metal and a metal plate hermetically secured to an open end of the housing;

a protrusion provided in the housing;

three conductive terminal pins inserted through three through holes formed in the metal plate and hermetically fixed by an electrically insulating filler respectively;

three fixed contacts secured to ends of the conductive terminal pins protruding into the hermetic container respectively;

a thermally responsive plate formed into a dish shape by drawing so as to reverse a direction of curvature at a predetermined temperature;

three movable contacts which are secured to the thermally responsive plate so as to be opposed to the fixed contacts respectively, thereby constituting three pairs of switching contacts together with the fixed contacts;

an elastic member holding a central part of the thermally responsive plate between the protrusion and the elastic member, thereby biasing the thermally responsive plate in such a direction that the thermally responsive plate departs from the fixed contacts; and a rotation preventing member which prevents the thermally responsive plate from rotation about a central part of the thermally responsive plate, thereby maintaining the movable contacts in an opposed state with respect to the fixed contacts respectively, wherein the conductive terminal pins are terminals located at a neutral point side of phase windings of the three-phase motor respectively in use of the protector, so that an AC current flowing into the three-phase motor is interrupted.

2. The protector according to claim 1, wherein the protrusion comprises a member made of solder.

3. The protector according to claim 2, wherein the elastic member is fixed via a support secured to the housing.

4. The protector according to claim 3, wherein the rotation preventing member comprises a part of the support connecting between the housing and the elastic member.

5. The protector according to claim 1, wherein the elastic member is fixed via a support secured to the housing.

6. The protector according to claim 5, wherein the rotation preventing member comprises a part of the support connecting between the housing and the elastic member.

* * * * *